US006142198A

United States Patent [19]

Amburgey et al.

[11] Patent Number: 6,142,198

[45] Date of Patent: Nov. 7, 2000

[54] APPLICATION OF MECHANICAL STRESS TO IMPROVE WOOD TREATABILITY

[75] Inventors: Terry L. Amburgey; H. Michael Barnes, both of Starkville; Michael G. Sanders, Sturgis, all of Miss.

[73] Assignee: Mississippi State University, Mississippi State, Miss.

[21] Appl. No.: 09/234,715

[22] Filed: Jan. 21, 1999

[51] Int. Cl.[7] ..... B27M 1/02

[52] U.S. Cl. ..... 144/361; 34/143; 144/329; 144/359; 144/364; 144/380; 427/393; 427/297; 428/106; 428/328; 428/537.5

[58] Field of Search ..... 144/329, 359, 144/361, 364, 380; 34/143, 145, 396, 398, 611, 225; 427/297, 325, 317, 346, 393, 440, 447; 428/18, 105, 106, 328, 537.5

[56] References Cited

U.S. PATENT DOCUMENTS 5,697,414 12/1997 Amburgey et al. ..... 144/361

OTHER PUBLICATIONS

Forest Products Journal, vol. 21 No. 2, pp. 41–50; Feb. 1971; "Dynamic Transverse Compression Treatment to Improve Drying Behavior of Yellow Birch"; M.Y. Cech.

Forest Products Journal, vol. 24, No. 7, pp. 26–32; Jul. 1974; "CCA Retention and Disproportioning in White Spruce"; M.Y. Cech, et al.

Forest Products Journal, vol. 38, No. 2, pp. 16–18; Feb. 1988; "Compression Rolling of Sitka Spruce and Douglas Fir"; H. Günzerodt, et al.

Forest Products Journal, vol. 18, No. 5, pp. 90–91; May, 1968; "Transverse Compression Treatment of Wood to Improve Its Drying Behavior"; M.Y. Cech, et al.

Forest Products Journal, vol. 20, No. 3, pp. 47–52; Mar. 1970, "Dynamic Transverse Compression Treatment of Spruce to Improve Intake of Preservatives"; M.Y. Cech, et al.

*Primary Examiner*—W. Donald Bray
*Attorney, Agent, or Firm*—Steven B. Kelber; Piper Marbury Rudnick & Wolfe LLP

[57] ABSTRACT

Application of vibration and/or compression to kiln-dried wood increases the retention and penetration of preservatives in the wood.

23 Claims, 3 Drawing Sheets

(2 of 3 Drawing Sheet(s) Filed in Color)

(blue color indicates copper penetration – red color indicates heartwood)

Task 3
308

(blue color indicates copper penetration – red color indicates heartwood)

APPLICATION OF MECHANICAL STRESS TO IMPROVE WOOD TREATABILITY

BACKGROUND OF THE INVENTION

1. Field of the Invention

The present invention relates to wood preservation processes. In particular, the present invention relates to processes for preserving wood by applying mechanical force in the form of vibration, compression, or vibration and compression to kiln-dried or air-dried wood prior to treating the wood with a preservative.

2. Discussion of the Background

The preservation of wood has long been a concern. Various methods of preserving wood have been developed in which wood is treated with a chemical preservative. However, the apparent non-treatability of heartwood faces on southern yellow pine (Pinus spp.) stock has caused much concern in the treating industry. Recently, even greater concern has been generated by the occurrence of what appears to be non-treatable inner sapwood. This inner sapwood does not respond to conventional heartwood indicators and has been referred to as "transition wood". The presence of heartwood and transition wood poses a serious problem when lumber is treated with water-borne preservative, because the heartwood and transition wood remains virtually untreated.

Cech, *For. Prod. J.,* 21(2):41–50, (1970); Cech, Plaff and Huffman, *For. Prod. J.,* 24(7):26–32, (1974); and Gunzerodt, *For. Prod. J.,* 38(2):16–18, (1988) discuss studies using white spruce, Douglas fir, Sitka spruce and yellow birch where transverse compression stresses were applied prior to wood treatment to improve drying and/or treatability. These studies indicated that treatability could be improved by mechanically stressing lumber prior to treatment. In particular, Cech, Plaff and Huffman, *For. Prod. J.,* 24(7):26–32, (1974) used compression forces on spruce heartwood to obtain an increase of 45% in preservative retention. When the same compression forces were combined with increased drying, an increase in retention of 210% was recorded.

Cech and Huffman, *For. Prod. J.,* 20(3):47–52, (1970) reported on a study in which freshly cut, 8/4 samples of eastern white spruce were subjected to varying compression forces prior to treatment with a water-borne preservative. It was determined that deformation or compression amounts of 5% or higher produced an increase in retention and cross-sectional penetration of a preservative.

Cech and Goulet, *For. Prod. J.,* 18(5):90–91, (1968) studied the use of compression to reduce drying time and drying defects. A slight reduction in modulus of rupture occurred in some samples at higher levels of compression or deformation. An increase in preservative retention of 19% was obtained at some of the lower levels of compression with no reduction in modulus of rupture.

However, the above-mentioned articles do not discuss the use of vibration alone or combined with compression to mechanically stress kiln-dried or air-dried wood prior to treatment with a preservative.

U.S. Pat. No. 5,697,414 discloses that combinations of vibration and compression can be used to prevent enzyme-induced sapwood discolorations in freshly-cut hardwood lumber. However, this patent does not discuss the use of vibration and/or compression to increase wood treatability.

Many markets for treated wood are now closed to southern yellow pine with heartwood faces and other refractory wood species because of inadequate preservative penetration in these woods. Thus, there is a need for improved processes for treating and preserving these woods.

SUMMARY OF THE INVENTION

This invention provides a treatment process for preserving refractory wood species; in particular, southern yellow pine with heartwood faces. In embodiments, the invention provides a process for treating wood which includes first applying mechanical force to kiln-dried or air-dried wood to form a pretreated wood, and then treating the pretreated wood with a wood preservative. The mechanical force can be vibration force, compression force, or a combination of the two. The pretreatment mechanical stress increases the retention and penetration of preservatives in wood.

BRIEF DESCRIPTION OF THE DRAWINGS

The file of this patent contains at least one drawing executed in color. Copies of this patent with color drawings will be proveded by the Patent and Trademark Office upon request and payment of the necessary fee.

The preferred embodiments of the invention will be described in detail, with reference to the following figures, wherein.

DETAILED DESCRIPTION OF THE INVENTION

Figure 1:
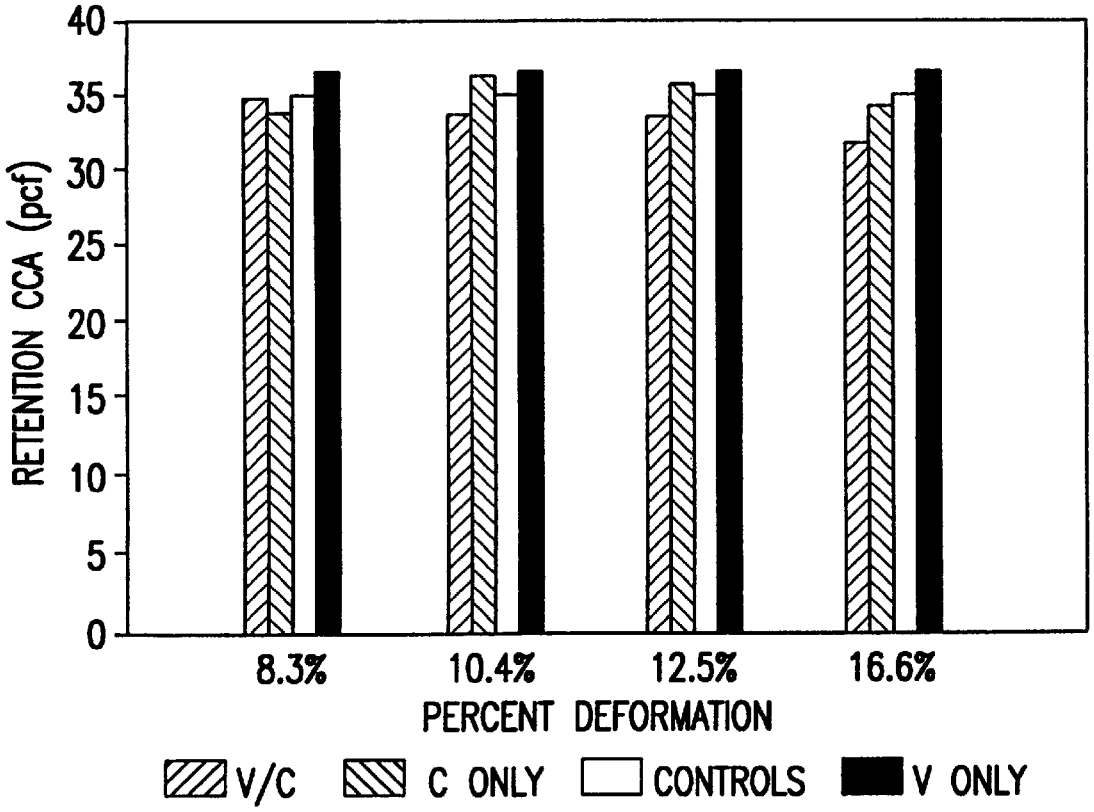
FIG. 1 shows the variation in retention of CCA wood preservative in southern yellow pine as a function of mechanical stress prior to treatment.

The present invention provides a method for enhancing wood preservation. In particular, the present invention provides a process of treating wood in which kiln-dried or air-dried wood is pretreated by mechanically stressing the wood with a mechanical force, and then the pretreated, mechanically stressed, wood is treated with a wood preservative.

Kiln-dried or air-dried wood can be produced by various methods well known to the skilled artisan. The kiln-dried or air-dried wood can be derived from various refractory woods, such as spruce. In embodiments, the kiln-dried or air-dried wood can be southern yellow pine, Douglas fir, spruce or other gymnosperms and angiosperms. Kiln-dried or air-dried wood containing heartwood or transition wood can also be treated according to the present invention.

According to the present invention, kiln-dried or air-dried wood is pretreated with mechanical stress by applying a mechanical force to the wood. The mechanical force can be vibration force, compression force or a combination of vibration force and compression force.

Vibration, as that term is used herein, relates to the repetitious (at least 2×) application and removal of pressure within a relatively short time. Compression, as that term is used herein, relates to the steady or constant application of pressure over a relative long time. In each case (vibration and/or compression pressure) enough force is applied to kiln-dried or air-dried wood for a time sufficient to improve the retention and penetration of a subsequently applied wood preservative in the mechanically stressed kiln-dried or air-dried wood as compared to unstressed wood.

Generally, compression pressure can be applied to kiln-dried or air-dried wood by pressure rollers, pressure plates, presses etc. A series of rollers, plates, presses, etc. may be used for kiln-dried or air-dried wood passing along a chain, to provide the desired dwell time for each board to be in contact with the pressure-applying device(s). Vibration pressure can be provided by pressure rollers, pressure plates, presses, etc., as well, but vibration pressure differs from compression pressure in that vibration pressure is applied for shorter periods of time than compression pressure and cycles between the application of pressure and release of pressure, as opposed to compression pressure which is relatively constant. A vibration frequency for the application of vibration pressure can be from about 500 to about 10,000 cycles/minute. Preferably, the vibration frequency is between about 8000 and about 10,000 cycles/minute, more preferably at about 9,000 cycles/minute. Vibration pressure is preferably applied for a period of time between about 0.1 seconds and about 10 minutes. Vibration pressure can also be provided by air, hydraulic, vibration, etc., motors, ultrasonic waves, vibrating boxes, or by the simple, mechanical hammering of kiln-dried or air-dried wood.

Preferred devices for the application of either compression or vibration pressure include a set of opposing pressure rollers, opposing pressure plates, a plate or impact (soil) tamper, an air vibration head, etc. The pressure-applying device(s) can be made of any material and preferably do not break or deform under the applied pressure. Preferably, the material used does not stain the wood being treated. For example, stainless steel is preferred over iron or mild steel.

The invention method for pretreating kiln-dried or air-dried wood prior to treating the wood with a preservative can thus be accomplished by simply hammering kiln-dried or air-dried boards, applying sufficient pressure and number of blows to enhance retention and penetration of wood preservative. More reproducible methods for improving retention and penetration of wood preservative include the application of controlled amounts of pressure for controlled amounts of time, including the passage of kiln-dried or air-dried lumber to be treated through, e.g., a pair of compression rollers, etc. Vibration pressure may be applied by passing over the surface of the kiln-dried or air-dried lumber with a plate or impact tamper similar to those used in the construction industries for compacting soils, asphalt, etc. Further, kiln-dried or air-dried lumber to be treated may be simply placed in a press, and a sufficient amount of pressure can be applied for the necessary amount of time to improve retention and penetration of wood preservative.

The amount of pressure applied and time period during which pressure is applied varies with the lumber species being treated and its physical characteristics, including thickness, presence of knots, percent heartwood, etc. Since knots are typically extremely hard it can be difficult to apply pressure to the surrounding sapwood with a device designed to treat large pieces of flat lumber, and care must be taken in treating sapwood, around knots with a relatively small pressure application device, such as a hammer, if such detail is required.

For typical pieces of kiln-dried or air-dried lumber the amount of pressure applied to improve retention and penetration of wood preservative varies from approximately 200 to 1800 psi, more preferably 400–1600 psi, most preferably 500–700 psi, for a time of between about 0.1 seconds to about 10 minutes, more preferably about 30 seconds to about 2 minutes. For an 8 foot board passing through a roller it is passed preferably at a rate of 1–10 seconds per foot. All pressures and times between the broadest ranges specified above are explicitly included herein, as are all ranges therebetween. Any amount of mechanical force applied to kiln-dried lumber (i.e., mechanical pressure) for a time sufficient to improve retention and penetration of wood preservative falls within the scope of the invention method. Preferably, the kiln-dried or air-dried lumber is treated on at least one surface thereof, meaning that at least 10%, preferably 50% more preferably 75%, most preferably at least 90% of the surface area of at least one surface of the subject piece of lumber has been treated according to the invention method and exhibits improved retention and penetration of wood preservative.

An apparatus for pretreating kiln-dried or air-dried wood with mechanical stress according to the present invention includes any apparatus capable of providing sufficient mechanical pressure for a sufficient time to kiln-dried or air-dried lumber so as to enhance retention and penetration of wood preservative. A preferred apparatus is a continuous one wherein a piece of lumber is passed through while having sufficient pressure applied to at least one surface thereof for the right amount of time. Such an apparatus preferably has one, more preferably two or more, "live" rollers, meaning rollers which are driven by a motor, etc., and which pull or push the piece of lumber through the apparatus. These live rollers may, optionally, also apply pressure, either compression or vibration pressure. While two opposing pressure rollers are preferred, a single pressure roller may be used if only one side of the piece of lumber is to be treated. Devices which apply compression or vibration pressure can be arranged to treat kiln-dried or air-dried lumber on one or more sides thereof, including all sides thereof, and this may be accomplished if desired, by a single passage through an apparatus having one or several devices which apply compression and/or vibration pressure arranged in series.

The pressure-applying devices in the invention apparatus include rollers having an internal vibration device which are capable of applying both compression pressure (i.e., a certain constant pressure) and vibration pressure (i.e., the repeated transient application and removal of pressure). Such rollers are termed compression/vibration rollers and operate in either mode. Pressure-applying devices should be made of a material which does not stain lumber (i.e., stainless steel) for best results. The pressure-applying device (s) can be heated. When infeed and outfeed rollers with small abrasions are used, the lumber can flow through the invention apparatus smoothly due to the push and pull of the live rollers.

A preferred apparatus according to the present invention is one termed a compression-vibration machine (CVM) which provides a continuous path having infeed rollers with small abrasions, and a series of alternating compression rollers and compression/vibration rollers (preferably three of each applying about 600 psi each) and an outfeed roller with small abrasions, a plate tamper providing vibrations and a vibrating conveyor that moves lumber along by vibrations arranged in series. The term "roller" as used in this description of the CVM refers to a set of top and bottom opposed rollers, the compression/vibration rollers operating in a vibrating mode (preferably at about 4700 cycles/minute). Appropriate bearings, shields, cylinders, power sources, pressure controls, electrical controls, etc., all well within the skill of the ordinary artisan, are provided for operation. The apparatus according to the present invention can be much more simple in design, however: a single compression roller situated atop a bench through which the operator pushes a piece of lumber, one or more times, for example.

Preferred rollers are stainless steel rollers having diameters of from 1–12 inches, preferably approximately 6 inches in diameter. Preferably, the pressure-applying device(s) have the same or greater width as the kiln-dried or air-dried lumber being treated, and where two opposed pressure devices are being used to treat two sides of a piece of lumber simultaneously, for example two opposed compression rollers, it is preferred that each roller provide the same pressure on each side of the piece of lumber, although this is not required.

Of course, certain additions and modifications to the invention apparatus can be present, such as an electric eye to measure board size and activate the positioning of pressure-applying devices downstream. It is emphasized, however, that an apparatus for applying mechanical force according to the present invention can be extremely simple in design, and an apparatus having only a single roller can provide acceptable results, such as, e.g., an 8 foot board one inch thick passed through the single roller five times, each pass taking 10 seconds, the roller applying a pressure of approximately 600 psi. Additionally, acceptable results are obtained by vibrating a soil tamper on top of kiln-dried or air-dried lumber.

After the kiln-dried or air-dried wood is mechanically stressed in a pretreatment step, the pretreated mechanically stressed wood is treated with a preservative. In embodiments, the preservative can be a water-borne preservative. In other embodiments, the preservative can include water-borne preservatives such as chromated copper arsenate, various triazoles (e.g., propiconazole, tebuconazole) and borates; ammoniacal preservative formulations such as ammoniacal copper quaternary ammonium compounds; and oil-borne preservatives such as pentachlorophenol, creosote and copper naphthenate. The mechanically stressed wood can be treated with a preservative by applying the preservative to the pretreated wood in various ways well known to the skilled artisan. For example, the preservative can be applied to the pretreated wood with a brush.

In embodiments, the kiln-dried or air-dried wood can be mechanically stressed by applying vibration force alone to form a pretreated wood, and the pretreated wood can then be treated with a preservative.

In other embodiments, the kiln-dried or air-dried wood can be pretreated by applying vibration force and compression force to form a pretreated wood, and the pretreated wood can then be treated with a preservative. The vibration force can be applied before the compression force, or the vibration force can be applied after the compression force. Alternatively, the vibration force and the compression force can be applied simultaneously.

In further embodiments, the kiln-dried or air-dried wood can be pretreated by applying compression force at ambient temperatures, without heating the kiln-dried or air-dried wood, and the pretreated wood can then be treated with a preservative.

The compression force can deform the kiln-dried or air-dried wood up to about 20% based on an undeformed, pre-stressed dimension of the kiln-dried or air-dried wood. The compression force, when applied without vibration force and without heating the kiln-dried or air-dried wood substantially above ambient temperatures, preferably deforms the kiln-dried or air-dried wood between about 5% and about 13%, based on an undeformed, pre-stressed, dimension of the kiln-dried or air-dried wood.

The term "ambient temperatures" as used herein refers to the temperature of the environment in which pressure applying devices operate to apply vibration force and/or compression force according to the invention. In embodiments ambient temperatures can range between about −40° C. and about 50° C. Preferably, ambient temperatures range between about 20° C. and about 25° C.

The invention having been generally described, reference is now made to examples, which are provided herein for purposes of illustration only, and are not intended to be limiting unless otherwise specified.

EXAMPLES

Forty kiln-dried, fourteen foot long, southern yellow pine 2×4's are obtained that contain as much heartwood as possible. Samples are selected for the uniformity of heartwood, from one end to the other, of each board. Each board is end-trimmed and cut into three specimens four feet in length. Samples from each board are designated to be pretreated by vibration only (V Only), vibration and compression (V/C), or compression only (C Only), or are designated as controls. The pretreatment is carried out at ambient temperatures.

Samples pretreated with compressive deformation (V/C and C Only samples) are deformed ⅛ inch, 5/32 inch, 3/16 inch, or ¼ inch, resulting in deformations of 8.3%, 10.4%, 12.5% or 16.6%, respectively, based on the undeformed 1.5 inch thickness of the 2×4 starting material.

Vibration force is applied to samples pretreated with vibration only (V Only) and to samples pretreated with vibration and compression (V/C).

After pretreatment with mechanical stress, the wood samples are treated with a water-borne preservative of copper chrome arsenate ("CCA").

Wood samples are weighed prior to treating with CCA, and again immediately after treatment with CCA, to determine the amount of CCA retained in the wood samples.

The wood samples are impregnated with CCA solution by first placing the wood samples in a treating vessel at an initial vacuum of 24 inches of mercury or greater. The CCA solution is then introduced to the wood samples under vacuum. The pressure is raised to 150 psig and held for one hour. The treating vessel is then vented to atmosphere and the CCA solution drained.

Following treatment, the wood samples are air dried for four weeks before having two cross-sectional samples, one inch long, removed from near midpoint. One of the samples is sprayed with an indicator that indicates heartwood. The other cross-sectional sample is sprayed with a copper indicator to determine preservative penetration.

Table 1 shows the CCA solution retained in wood samples pretreated with vibration only. (The term "pcf" stands for pounds of CCA solution retained per cubic foot of wood.) Table 2 shows the CCA solution retained in control samples. Table 3 shows the CCA solution retained in wood samples pretreated with simultaneous vibration/compression and compression only, where the compression produces a compressive deformation of 8.3%. Table 4 shows the CCA solution retained in wood samples pretreated by simultaneous vibration and compression or compression only, where the compression produces a compressive deformation of 10.4%. Table 5 shows the CCA solution retained in wood samples pretreated by simultaneous vibration and compression or compression only, where the compression produces a compressive deformation of 12.5%. Table 6 shows the CCA solution retained in wood samples pretreated by simultaneous vibration and compression or compression only, where the compression produces a compressive deformation of 16.6%.

TABLE 1

| Vibration Only | | |
|---|---|---|
| Wood Sample | Initial Weight (grams) | CCA retained (pcf) |
| 301 | 2306.0 | 37.8 |
| 302 | 2373.5 | 39.2 |
| 303 | 3003.0 | 25.8 |
| 304 | 2597.5 | 22.0 |
| 305 | 2126.0 | 42.4 |
| 306 | 1978.5 | 41.6 |
| 307 | 2089.5 | 34.7 |
| 308 | 2385.0 | 35.4 |
| 309 | 2503.0 | 37.7 |
| 310 | 2780.0 | 36.8 |
| 311 | 1969.5 | 41.3 |
| 312 | 2147.0 | 41.1 |
| 313 | 2330.5 | 28.1 |
| 314 | 2103.0 | 37.1 |
| 315 | 2046.0 | 39.5 |
| 316 | 2270.0 | 38.3 |
| 317 | 2078.0 | 38.2 |
| 318 | 2085.5 | 39.0 |
| 319 | 2596.0 | 38.4 |
| 320 | 2537.0 | 37.5 |
| | | AVR 36.6 |

TABLE 2

| Controls | | |
|---|---|---|
| Wood Sample | Initial Weight (grams) | CCA Retained (pcf) |
| 321 | 1995.5 | 43.3 |
| 322 | 2665.5 | 23.8 |
| 323 | 2405.5 | 38.2 |
| 324 | 2159.5 | 43.5 |
| 325 | 2368.5 | 32.9 |
| 326 | 2445.5 | 40.4 |
| 327 | 2608.0 | 35.5 |
| 328 | 2360.0 | 33.2 |
| 329 | 2471.5 | 37.5 |
| 330 | 2005.5 | 42.1 |
| 331 | 2592.0 | 33.4 |
| 332 | 2460.0 | 32.2 |
| 333 | 3174.0 | 22.8 |
| 334 | 2446.5 | 39.5 |
| 335 | 1754.5 | 44.0 |
| 336 | 2502.0 | 19.1 |
| 337 | 2144.5 | 40.8 |
| 338 | 2497.5 | 16.4 |
| 339 | 2156.0 | 35.0 |
| 340 | 2205.5 | 43.8 |
| | | AVR 34.9 |

TABLE 3

| Compressive Deformation (8.3%) | | | | |
|---|---|---|---|---|
| | Vibration/Compression | | Compression Only | |
| Wood Sample | Initial Weights (grams) | CCA Retained (pcf) | Initial Weight (grams) | CCA Retained (pcf) |
| 301 | 2238.0 | 37.6 | 2275.5 | 36.9 |
| 302 | 2550.0 | 37.1 | 2432.5 | 38.4 |
| 303 | 2716.5 | 31.2 | 2798.5 | 24.9 |
| 304 | 2441.5 | 25.6 | 2527.5 | 24.0 |
| 305 | 2457.0 | 41.3 | 2256.0 | 42.1 |
| 306 | 2072.0 | 38.2 | 1978.0 | 32.7 |
| 307 | 2254.0 | 36.2 | 2205.0 | 35.9 |
| 308 | 2614.5 | 32.9 | 2379.5 | 24.7 |
| 309 | 2819.5 | 32.5 | 2733.5 | 37.6 |
| 310 | 2414.5 | 35.6 | 2527.0 | 40.6 |
| | | AVR 34.8 | | AVR 33.8 |

TABLE 4

| Compressive Deformation (10.4%) | | | | |
|---|---|---|---|---|
| | Vibration/Compression | | Compression Only | |
| Wood Sample | Initial Weights (grams) | CCA Retained (pcf) | Initial Weight (grams) | CCA Retained (pcf) |
| 311 | 2143.0 | 33.4 | 2190.0 | 37.3 |
| 312 | 1993.5 | 38.8 | 2286.0 | 34.8 |
| 313 | 2613.0 | 30.7 | 2417.5 | 33.9 |
| 314 | 2008.0 | 27.4 | 1974.0 | 25.8 |
| 315 | 2020.5 | 36.1 | 2009.0 | 38.7 |
| 316 | 2078.5 | 37.3 | 2163.5 | 37.5 |
| 317 | 2125.0 | 32.7 | 2044.5 | 39.9 |
| 318 | 2232.0 | 31.6 | 2075.5 | 39.0 |
| 319 | 2295.0 | 37.2 | 2509.0 | 38.5 |
| 320 | 2662.0 | 31.6 | 2552.0 | 37.6 |
| | | AVR 33.7 | | AVR 36.3 |

TABLE 5

| Compressive Deformation (12.5%) | | | | |
|---|---|---|---|---|
| | Vibration/Compression | | Compression Only | |
| Wood Sample | Initial Weight (grams) | CCA Retained (pcf) | Initial Weight (grams) | CCA Retained (pcf) |
| 321 | 1900.0 | 35.8 | 2022.5 | 41.1 |
| 322 | 2473.0 | 30.7 | 2342.5 | 32.6 |
| 323 | 2639.0 | 38.3 | 2459.0 | 40.4 |
| 324 | 2421.5 | 38.2 | 2246.5 | 41.7 |
| 325 | 2508.0 | 24.1 | 2446.5 | 31.6 |
| 326 | 2477.5 | 35.3 | 2331.5 | 38.0 |
| 327 | 2547.0 | 34.2 | 2623.5 | 33.8 |
| 328 | 2354.5 | 23.8 | 2379.5 | 26.0 |
| 329 | 2354.0 | 38.2 | 2242.0 | 32.4 |
| 330 | 2309.5 | 38.4 | 2126.5 | 40.0 |
| | | AVR 33.7 | | AVR 35.8 |

TABLE 6

| Compressive Deformation (16.6%) | | | | |
|---|---|---|---|---|
| | Vibration/Compression | | Compression Only | |
| Wood Sample | Initial Weights (grams) | CCA Retained (pcf) | Initial Weight (grams) | CCA Retained (pcf) |
| 331 | 2781.5 | 33.8 | 2630.0 | 33.9 |
| 332 | 2622.0 | 31.3 | 2381.0 | 36.5 |
| 333 | 2626.5 | 24.8 | 2625.0 | 25.1 |
| 334 | 2706.5 | 32.8 | 2449.0 | 38.6 |
| 335 | 1645.0 | 45.7 | 1661.0 | 45.6 |
| 336 | 2736.0 | 20.3 | 2602.5 | 22.7 |
| 337 | 2201.0 | 39.2 | 2187.5 | 40.4 |
| 338 | 2418.0 | 33.2 | 2462.0 | 32.4 |
| 339 | 2138.0 | 26.4 | 2218.5 | 33.3 |
| 340 | 2346.5 | 31.4 | 2265.0 | 34.8 |
| | | AVR 31.9 | | AVR 34.3 |

FIG. 1 plots average CCA retention levels versus deformation for the southern yellow pine samples of Tables 1–6. In FIG. 1, the V/C (vibration/compression) and C Only (compression only) results at four levels of deformation are each compared with the same Control and V Only (vibration only) results. The Control and V Only results were both obtained at zero compressive deformation. Samples stressed by vibration only, and samples stressed only by compressive deformation of 10.4% and 12.5%, show CCA retention exceeding that of the control samples. Samples stressed by vibration only show the highest average retention of CCA.

Figure 2:
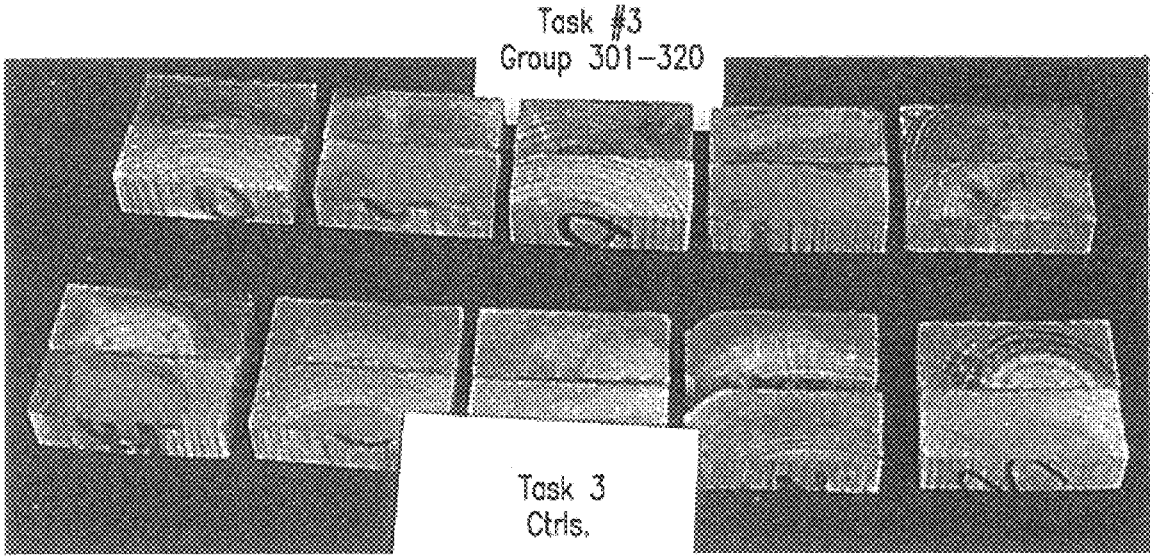
FIG. 2 compares the penetration of CCA wood preservative in southern yellow pine pre-treated using vibration only with un-stressed control samples.

FIG. 2 compares the penetration of CCA preservatives in samples pretreated using vibration only with unstressed control samples. Samples stressed using vibration only show better penetration of CCA than the unstressed controls.

Figure 3:
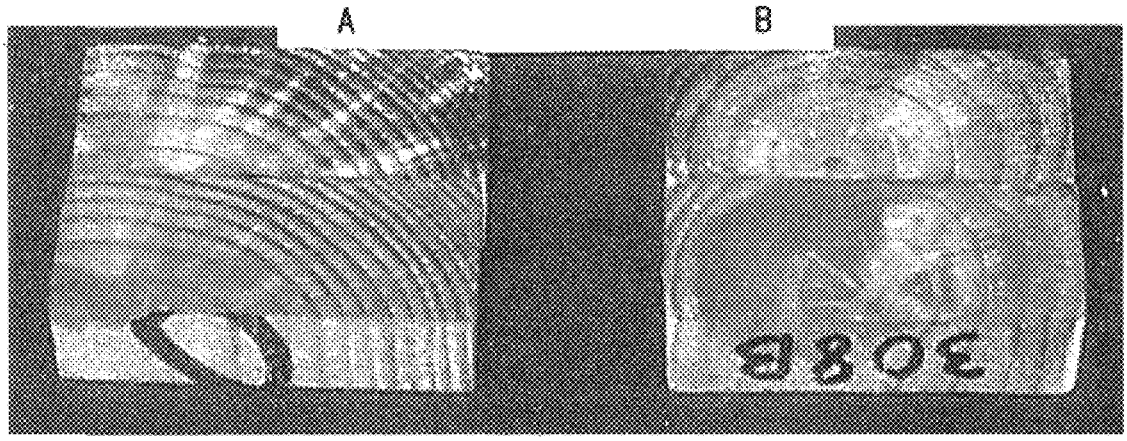
FIG. 3 compares the penetration of CCA wood preservative in southern yellow pine pre-treated using a combination of vibration and compressive deformation with a sample pre-treated using the same level of compressive deformation but no vibration.

FIG. 3 compares the preservative penetration in samples pretreated using a combination of vibration and compression with samples stressed by compression only, for a compressive deformation of 8.3%. For compressive deformations of 10% or less, vibration/compression samples show better CCA penetration than samples stressed using compression alone. Higher levels of compressive deformation in the compression/vibration samples results in no improvement in CCA penetration over samples stressed using compression alone.

While the present invention has been described with reference to specific embodiments, it is not confined to the specific details set forth, but is intended to convey such modifications or changes as may come within the skill in the art.

What is claimed is:

1. A process for treating wood, comprising applying vibration force to kiln-dried or air-dried wood to form a pretreated wood, and treating the pretreated wood with a preservative.

2. The process according to claim 1, wherein the vibration force has a vibration frequency between about 500 and about 10,000 cycles/minute.

3. The process according to claim 1, wherein the vibration force is applied to the kiln-dried or air-dried wood for a period of time between about 0.1 seconds and about 10 minutes.

4. The process according to claim 1, wherein the preservative comprises a chemical composition selected from the group consisting of water-borne preservatives and oil-borne preservatives.

5. The process according to claim 1, wherein the preservative comprises an ammoniacal preservative.

6. The process according to claim 1, wherein the kiln-dried or air-dried wood is a wood selected from the group consisting of gymnosperms and angiosperms.

7. The process according to claim 1, wherein the kiln-dried or air-dried wood is a wood selected from the group consisting of southern yellow pine, Douglas fir and spruce.

8. The process according to claim 1, wherein said preservative comprises an amine-type preservative.

9. The process according to claim 10, wherein said preservative comprises an amine-type preservative.

10. A process for treating wood, comprising:

applying a mechanical force to kiln-dried or air-dried wood to form a pretreated wood, and treating the pretreated wood with a preservative;

wherein said mechanical force is one of a vibration force, a compression force and a combination thereof.

11. The process according to claim 10, wherein the mechanical force is applied to the kiln-dried or air-dried wood at the pressure of from about 200 to about 1800 psi.

12. The process according to claim 10, wherein the mechanical force is applied to the kiln-dried or air-dried wood for a period of time between about 0.1 seconds and about 10 minutes.

13. The process according to claim 10, wherein the mechanical force comprises at least one of a vibration force and a compression force.

14. The process according to claim 13, wherein the compression force and the vibration force, or the vibration force and the compression force, are applied to the kiln-dried or air-dried wood sequentially.

15. The process according to claim 13, wherein the compression force and the vibration force are applied to the kiln-dried or air-dried wood simultaneously.

16. The process according to claim 13, wherein the vibration force has a vibration frequency between about 500 and about 10,000 cycles/minute.

17. The process according to claim 13, wherein the vibration force is applied to the kiln-dried or air-dried wood for a period of time between about 0.1 seconds and about 10 minutes.

18. The process according to claim 13, wherein the compression force deforms the kiln-dried or air-dried wood between about 5% and about 13% based on an undeformed dimension of the kiln-dried or air-dried wood.

19. The process according to claim 10, wherein the preservative comprises a chemical composition selected from the group consisting of water-borne preservatives and oil-borne preservatives.

20. The process according to claim 10, wherein the preservative comprises an ammoniacal preservative.

21. The process according to claim 10, wherein the kiln-dried or air-dried wood is a wood selected from a group consisting of gymnosperms and angiosperms.

22. The process according to claim 10, wherein the kiln-dried or air-dried wood is a wood selected from the group consisting of southern yellow pine, Douglas fir and spruce.

23. The process according to claim 10, wherein said mechanical force is applied at a temperature of about −40° C. to about 50° C.

* * * * *